US005396721A

United States Patent [19]

Levine et al.

[11] Patent Number: 5,396,721

[45] Date of Patent: Mar. 14, 1995

[54] TENSIONING DEVICE

[75] Inventors: Robert S. Levine, Atkinson, N.H.; Mark R. Goodwin, Anson, Me.

[73] Assignee: Kirpalanies, Inc., Atkinson, N.H.

[21] Appl. No.: 122,058

[22] Filed: Sep. 15, 1993 (Under 37 CFR 1.47)

[51] Int. Cl.[6] ..... D06C 3/08; C14B 1/26

[52] U.S. Cl. ..... 38/102.3; 38/102.5; 38/102.91; 69/19.1

[58] Field of Search ..... 69/19, 19.1, 19.2, 19.3; 38/102.91, 102, 102.1, 102.4, 102.5, 102.6, 102.3; 112/103, 119, 121.15

[56] References Cited

U.S. PATENT DOCUMENTS

| | | | |
|---|---|---|---|
| 1,706,283 | 3/1929 | Flink | 38/102.6 |
| 1,849,707 | 3/1932 | Clark | 38/102.91 |
| 2,325,268 | 7/1943 | Nelson | 38/102.1 |
| 2,588,661 | 3/1952 | Ruby | 38/102.91 |
| 3,814,038 | 6/1974 | Dorosz et al. | 112/121.15 |
| 3,988,993 | 11/1976 | Brophy | 112/121.12 |
| 4,309,950 | 1/1982 | Franklin | 112/103 |
| 4,422,310 | 12/1983 | Eggenberger | 69/19.3 |
| 4,561,177 | 12/1985 | Rancer | 29/721 |

*Primary Examiner*—Clifford D. Crowder
*Assistant Examiner*—Michael A. Neas
*Attorney, Agent, or Firm*—Hayes, Soloway, Hennessey, Grossman & Hage

[57] ABSTRACT

A holding and tensioning device for leather and leather-like pieces of material having a pallet and a pair of adjustable positioning clamps mounted on the pallet is provided. Advantageously, the device of the instant invention is capable of holding the piece in place without damaging it, as was the case in the prior art.

14 Claims, 2 Drawing Sheets

TENSIONING DEVICE

BACKGROUND OF THE INVENTION

1. Field of the Invention

The present invention relates generally to holding and tensioning devices for leather and leather-like pieces of material and specifically for clamping and tensioning devices used to locate and hold leather pieces while stitching decorative thread patterns in the leather with an automatic stitching machine. The invention has particular utility in connection with stitching leather boot uppers and will be described in connection with such utility, although other utilities are contemplated.

2. Description of the Prior Art

Western style "cowboy" boots are manufactured by sewing together upper portions of leather known as "quarters" or "panels". A boot quarter is typically a flat piece of single or multi-ply leather or leather-like material with at least two straight opposing edges and two roughly straight, curved, or, most typically, chevron shaped opposing edges at 90° to the straight edges. The quarter, which can be either leather, leather-like material, or a synthetic substitute, is clamped into a frame or fixture known as a "pallet". The pallet locates or orients the boot quarter and holds the same in place so that decorative thread patterns can be stitched in the boot quarter with an automatic stitching machine. The automatic stitching machines may be hand operated or numerically controlled. Often, pallets are "ganged" so that several boot quarters can be stitched with the same or similar pattern in succession, thus increasing manufacturing speeds.

Prior pallet designs clamped the outer opposing edges of the boot quarter onto the side of the frame. For example, U.S. Pat. No. 4,422,310 issued to Eggenberger on Dec. 27, 1983 teaches a pallet comprising pivoting bars mounted on base strips by toggle mechanisms and having a plurality of pins on the underside which engage and pierce the edges of the boot quarter. These pins are received in corresponding holes located on base strips attached to the pallet. While the leather is drawn taut such that close rows of decorative stitches can be made without stitch overlap, this tensioning device necessitates the creation of a plurality of holes on the edges of the leather boot quarter. Furthermore, the Eggenberger patent does not define means for determining the positional coordinates of the boot quarter surface to facilitate the use of numerically controlled stitching machines.

A need exists, therefore, for a device which will not only properly locate the boot quarter in the pallet and support the same for stitching, but which will also tension the quarter without the need for piercing and subsequent damaging or marring of the edges of the boot quarter.

OBJECTS AND SUMMARY OF THE INVENTION

A primary object of the present invention is to provide a new and useful tensioning device for clamping and positioning leather or leather-like quarters which provides for stretching the boot quarter in preparation for stitching without the need for piercing the edges or otherwise damaging the material.

A further object of the present invention is to provide a boot quarter tensioning device that provides for the determination of positional coordinates on the surface of the leather or leather-like boot quarter so that numerically controlled stitching machines may be used to embroider and/or stitch decorative patterns onto the surface of the boot quarter.

A tensioning device for leather and leather-like materials according to this invention comprises a pallet having two pairs of opposing frame members and a pair of adjustable positioning clamps respectively slidably mounted on one of the two pairs of the frame members. The positioning clamps include a positioning bar, two positioning pegs that are mounted on and extend from a surface of the bar and are spaced from one another so as to contact two respective sides of the leather-like material, and fastening means, such as a screw or pin, for engaging the positioning bar to prevent it from moving relative to the pallet.

In use, the positioning bar is slidably adjusted so that the positioning pegs are seated adjacent the two respective opposing sides of the material. The positioning bar is then fastened to the position clamp, by tightening a screw or the like, so as to positively fix the material in position on the pallet. In this way, the material is held on the pallet between the adjustable positioning clamps ready for tensioning. Once the material has been positioned between the positioning clamps, two dove tail rails (which may either be fixed to the pallet or removable therefrom) are positioned so as to impinge upon the material in preparation for clamping. Preferably, the dove tail rails are shorter in length than the material piece. The piece may then either be manually or automatically tensioned prior to clamping. The dove tail rails include means for clamping onto and holding taut the thus tensioned piece. Advantageously, the clamping means are slidably mounted on the dove tail rails. Thus, the piece is held taut on the pallet between the dove tail rails and the positioning pegs.

BRIEF DESCRIPTION OF THE DRAWINGS

Other objects, advantages, and novel features of the present invention will become apparent from the following Detailed Description of the invention when considered in conjunction with the accompanying drawings, wherein.

DETAILED DESCRIPTION OF PREFERRED EMBODIMENTS

Figure 1:
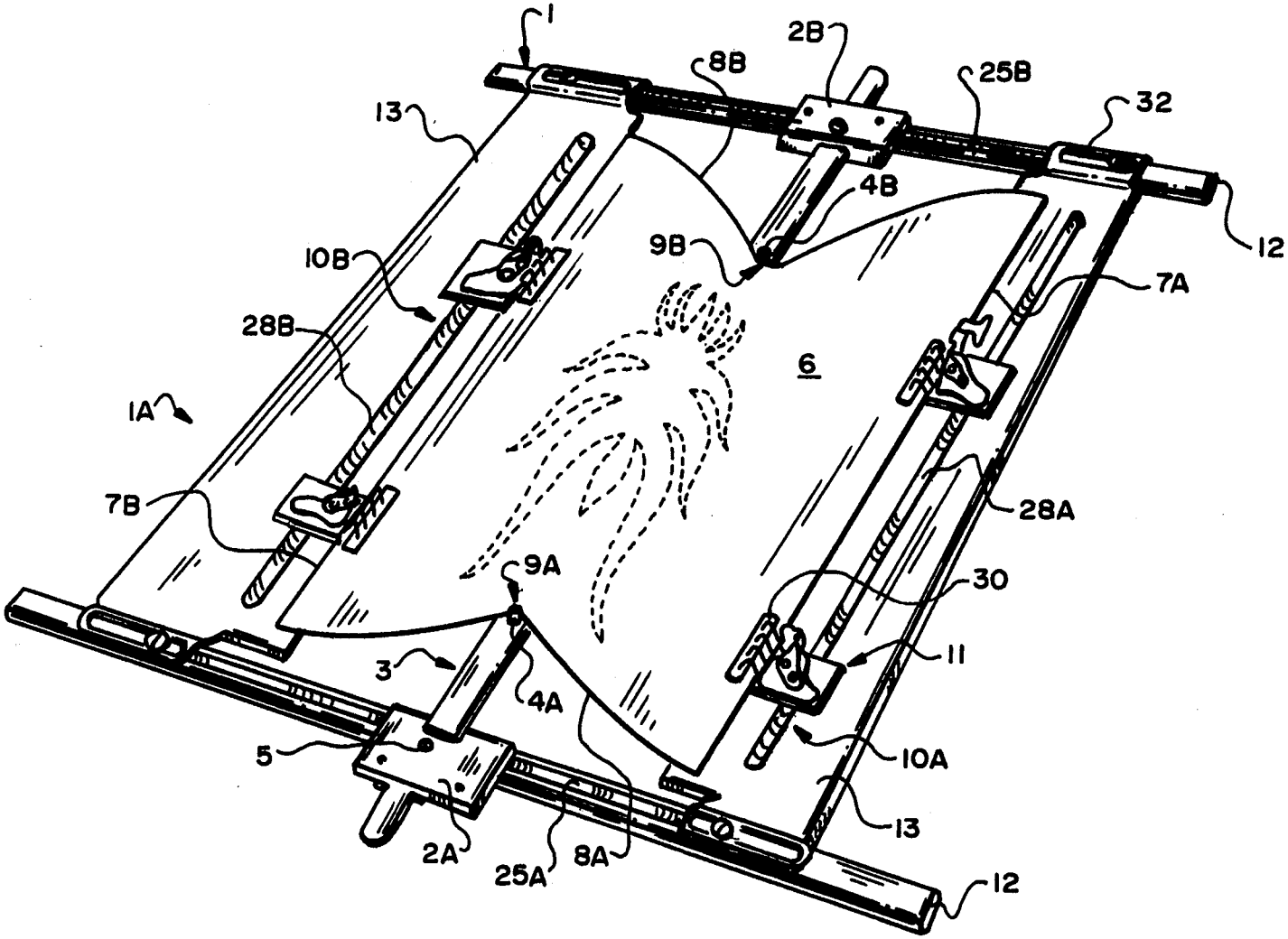
FIG. 1 is a perspective view of the preferred embodiment of a device according to the present invention.

A preferred embodiment of a device 1A according to the present invention has a metallic or wooden pallet 1 made up of two pairs 12, 13 of opposing frame members and a pair of adjustable positioning clamps 2A, 2B slidably mounted in, preferably, tracks 25A, 25B on one pair 12 of members of the pallet 1, as illustrated in FIG. 1. The adjustable positioning clamps 2A, 2B are made up of a positioning bar 3 having two positioning pegs 4A, 4B mounted on and extending from a surface of the bar 3, and suitable fastening means 5, such as a screw or pin, for engaging the positioning bar 3 to hold it in a desired position relative to the pallet 1. As stated previously, a boot quarter 6 is most typically a flat piece of single or multi-ply leather or leather-like material with two straight opposing edges 7A, 7B and two roughly straight, curved, or chevron shaped opposing edges 8A, 8B at about 90° to the straight edges 7.

In such a typical boot quarter construction, the device 1A of the present invention places adjacent the apices 9A, 9B of the chevron shaped edges 8A, 8B of the boot quarter 6 the two pegs 4A, 4B, respectively. The positioning bar 3 is slidably adjusted so that the positioning peg 4A may be seated in the apex 9A of the chevron shaped edge 8A. The other peg 4B may then be placed in position on the bar 3 adjacent the other side 8B in the apex 9B. Of course, the order of peg seating may be reversed. The positioning bar 3 is then fastened to the position clamp 2, by tightening a screw 5 or the like, whereby the boot quarter 6 is positively affixed in position on the pallet 1. In this way, the boot quarter 6 is held on the pallet 1 ready for tensioning.

Once the boot quarter 6 has been positioned between the pegs 4A, 4B, two dove tail rails 10A, B (which may either be fixed to the pallet 1 or removable therefrom via, for example, screw locks 32, are placed adjacent the edges 7 of the quarter 6). The dove tail rails 10A, B preferably are shorter in length than the boot quarter 6. The quarter 6 may be either manually or automatically tensioned prior to clamping. Once the dove tail rails 10A, B are placed adjacent the edges 7 of a boot quarter 6 (either tensioned or untensioned), the rails 10A, B are preferably clamped in place and held there immovably by toggle clamps, representatively referred to by numeral 11. Toggles 11 preferably comprise conventional toggle clamping mechanisms, as will be known to those skilled in the art. Swinging spring clamp mechanisms 30 (comprised within the toggle clamp mechanisms 11) of conventional construction are then used to hold the sides 7A, 7B of the boot quarter in place on the pallet, without damaging the quarter 6. Thus, the boot quarter 6 is held taut on the pallet 1 between the dove tail rails 10A, 10B and the positioning pegs 4A, 4B. In this preferred embodiment, the spring clamps 30A, 30B run substantially the entire length of the sides 7A, 7B, so as to provide uniform tension along the entire quarter 6. Further, according to the instant invention, the rails 11 are slidably mounted in, preferably, track means 28A, 28B, as shown in FIG. 2.

Figure 2:
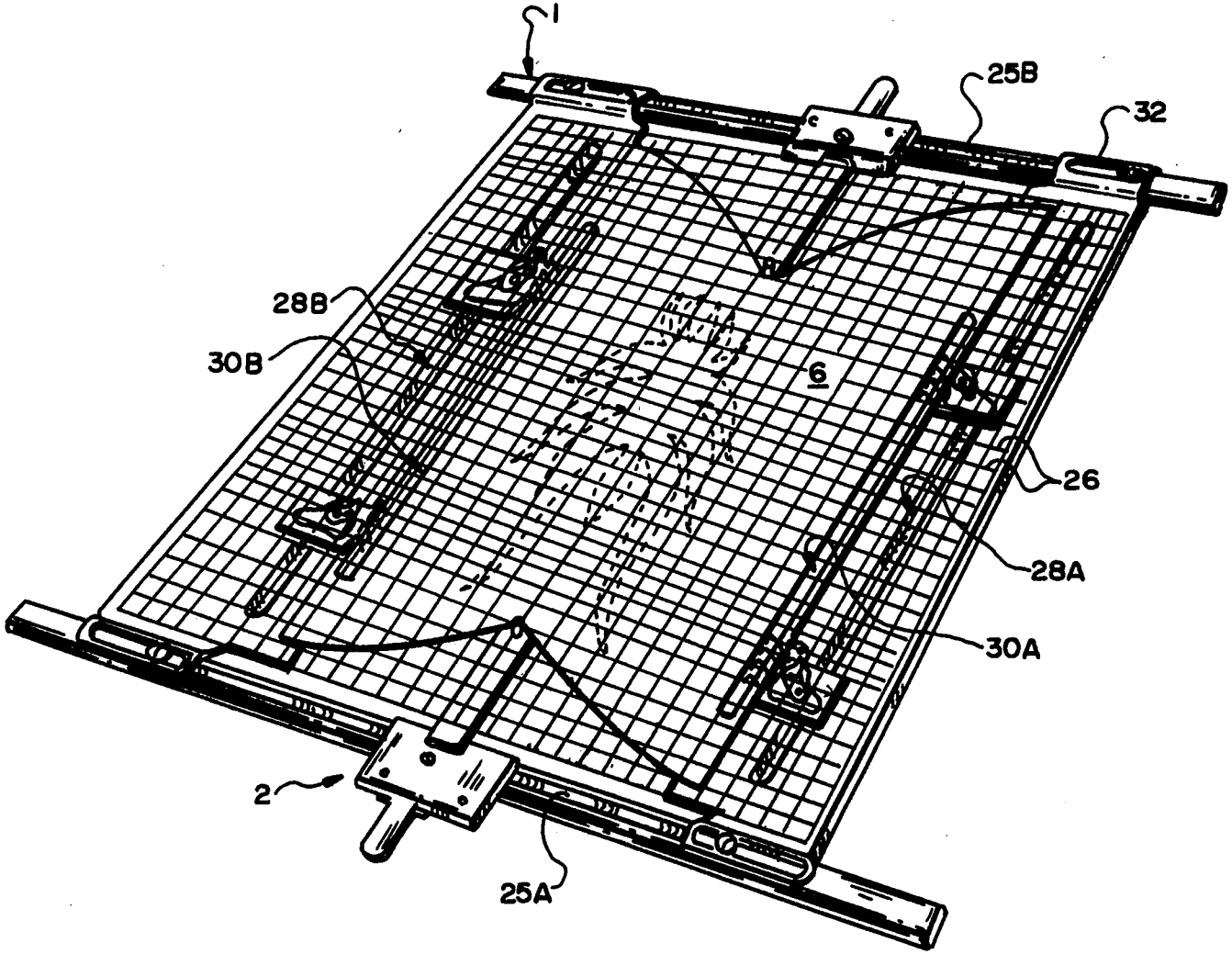
FIG. 2 is a perspective view of the embodiment shown in FIG. 1, but including a webbing system for locating the position of the boot quarter relative to the pallet.

In the embodiment of the present invention shown in FIG. 2, a numerically controlled automatic stitching machine may use positions of the material 6 determined using the web 26 (in this embodiment, of grid-like construction, although other constructions are possible) as references to facilitate automatically stitching decorative patterns onto the boot quarter 6.

While the above disclosure provides a full and complete disclosure of the preferred embodiments of the instant invention, various modifications, alternatives and equivalents may be employed without departing from the spirit and scope thereof. For example, two or more pallets may be fashioned according to the instant invention and "ganged" together so that several boot quarters may be stitched at the same time to reduce manufacturing time. Additionally, if the dimensions of the material piece 6 are known or predetermined, the locks 32 may be eliminated, the rails fixed to the frame, and the positioning bar may also be fixed to the frame. Also, the bar may comprise a plurality of peg holes adapted to permit the pegs to be placed therein, so as to allow the distance between the pegs to be adjustable thereby. Therefore, the above description and illustrations should not be construed as limiting the scope of the invention, which is defined only by the hereinafter appended claims.

What is claimed is:

1. A device for use in holding and tensioning a piece of material, and comprising, in combination:

a. a pallet having two pairs of opposing frame members;

b. two adjustable positioning clamps respectively slidably mounted on one of said two pairs of opposing members and including a positioning bar movable therebetween, said positioning bar having two adjustable pegs for placing adjacent thereto two respective opposing sides of said piece, said pegs being mountable on and extending from said bar, said positioning clamps also including fastening means for engaging said positioning bar to prevent said bar from moving between said two positioning clamps; and c. two dove tail rails positionable so as to be able to impinge upon said material piece and oriented so as to be parallel to the other of said two opposing frame members, said dove tail rails including means for clamping onto and holding taut said material piece, said clamping means being slidably mounted on said dove tail rails.

2. A device according to claim 1, wherein said clamping means further includes means for preventing said clamping means from sliding on said dove tail rails.

3. A device according to claim 1, wherein said two pegs are in a fixed spaced-apart relationship relative to each other adapted to snuggly contact said two opposing sides of said material piece.

4. A device according to claim 2, wherein said sliding preventing means comprises toggle clamps.

5. A device according to claim 1, wherein said dove tail rails are shorter in length than said material piece.

6. A device according to claim 1, wherein said fastening means comprises an adjustable screw.

7. A device according to claim 1, wherein said fastening means comprises screw clamps.

8. A device according to claim 1, and further comprising, means for determining the position of said piece relative to pallet.

9. A device according to claim 8, wherein said determining means comprises a web net of grid-like construction.

10. A device according to claim 1, wherein said dove tail rails are removable from said pallet.

11. A device according to claim 1, wherein said holding and tensioning means comprises swinging spring clamps.

12. A device according to claim 1, wherein said dove tail rails are fixed to said pallet.

13. A system for use in holding and tensioning a plurality of pieces of material, and comprising a plurality of devices according to claim 1 ganged together.

14. A device according to claim 1, wherein said material piece is a boot quarter.

* * * * *